US011571796B2

(12) United States Patent
Young et al.

(10) Patent No.: US 11,571,796 B2
(45) Date of Patent: Feb. 7, 2023

(54) ROTARY HAMMER

(71) Applicant: MILWAUKEE ELECTRIC TOOL CORPORATION, Brookfield, WI (US)

(72) Inventors: Tyler Young, Waukesha, WI (US); Joseph R. Beeson, West Allis, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 443 days.

(21) Appl. No.: 16/374,909

(22) Filed: Apr. 4, 2019

(65) Prior Publication Data

US 2019/0308307 A1 Oct. 10, 2019

Related U.S. Application Data

(60) Provisional application No. 62/652,580, filed on Apr. 4, 2018.

(51) Int. Cl.
*B25D 17/24* (2006.01)
*B25D 16/00* (2006.01)

(52) U.S. Cl.
CPC ..... *B25D 17/24* (2013.01); *B25D 16/006* (2013.01); *B25D 16/003* (2013.01);
(Continued)

(58) Field of Classification Search
CPC ..... B25D 17/24; B25D 16/006; B25D 2250/331; B25D 16/003;
(Continued)

(56) References Cited

U.S. PATENT DOCUMENTS 1,845,825 A * 2/1932 Benedict ..... B25D 17/043 173/162.2
3,028,840 A 4/1962 Leavell
(Continued)

FOREIGN PATENT DOCUMENTS

CN 102672511 A * 9/2012 ..... B23Q 3/15513
CN 106715949 B * 3/2019 ..... B25D 17/24
(Continued)

OTHER PUBLICATIONS

International Search Report and Written Opinion for Application No. PCT/US2019/025718, dated Jul. 23, 2019, 13 pages.
(Continued)

*Primary Examiner* — Robert F Long
(74) *Attorney, Agent, or Firm* — Michael Best & Friedrich LLP

(57) ABSTRACT

A rotary hammer is adapted to impart axial impacts to a tool bit. The rotary hammer comprises a housing, a motor supported by the housing, a gearcase, and a spindle housed in the gearcase and coupled to the motor for receiving torque from the motor, causing the spindle to rotate. The rotary hammer also comprises a reciprocating impact mechanism operable to create a variable pressure air spring within the spindle. The rotary hammer also comprises a vibration damping mechanism including a base on the gearcase, a counterweight circumscribing the base, and a first spring arranged between the base and the counterweight and defining a first biasing axis that is parallel to the reciprocation axis. The vibration damping mechanism also includes a second spring arranged between the base and the counterweight and arranged along the first biasing axis.

19 Claims, 9 Drawing Sheets

(52) U.S. Cl.
CPC ..... *B25D 2216/0084* (2013.01); *B25D 2217/0092* (2013.01); *B25D 2250/331* (2013.01)

(58) Field of Classification Search
CPC .... B25D 2217/0092; B25D 2216/0084; B25D 11/125; B25D 2216/0015; B25D 2216/0023; B25D 2216/0038
USPC ..... 173/95, 162.1–162.1, 2, 104, 211
See application file for complete search history.

(56) References Cited

U.S. PATENT DOCUMENTS 3,028,841 A 4/1962 Leavell
3,335,805 A 8/1967 Diez et al.
RE27,567 E * 1/1973 Baumgardner ..... F02G 1/057 290/1 R
3,727,700 A 4/1973 Amtsberg
3,743,266 A * 7/1973 Sturman ..... B60R 19/28 267/31
3,845,827 A * 11/1974 Schulin ..... B27B 17/0033 173/162.1
4,014,392 A * 3/1977 Ross ..... B25D 11/125 173/117
4,072,199 A 2/1978 Wanner
4,094,198 A * 6/1978 Moulinoux ..... G01M 1/16 73/471
4,328,708 A * 5/1982 Bagwell ..... G01N 29/26 73/622
4,401,167 A * 8/1983 Sekizawa ..... B25D 17/043 173/162.1
4,442,738 A * 4/1984 Spencer ..... B25B 23/145 81/474
4,478,293 A 10/1984 Weilenmann et al.
5,161,303 A * 11/1992 Maynard ..... B23P 19/062 221/113
5,411,508 A * 5/1995 Bessler ..... A61B 17/1114 227/19
5,645,556 A * 7/1997 Yoon ..... A61B 17/3417 604/164.09
5,692,574 A * 12/1997 Terada ..... B25D 17/043 173/162.2
6,148,930 A * 11/2000 Berger ..... B25D 17/043 173/162.2
6,286,610 B1 * 9/2001 Berger ..... B25F 5/006 173/162.1
6,863,479 B2 * 3/2005 Frauhammer ..... B25D 17/043 16/426
7,096,973 B2 8/2006 Ikuta et al.
7,143,842 B2 12/2006 Ikuta
7,252,157 B2 8/2007 Aoki
7,331,407 B2 2/2008 Stirm et al.
7,383,895 B2 6/2008 Aoki
7,445,056 B2 11/2008 Stirm et al.
7,469,752 B2 12/2008 Furusawa et al.
7,513,317 B2 4/2009 Satou
7,523,791 B2 4/2009 Aoki
7,533,736 B2 5/2009 Stirm et al.
7,562,721 B2 7/2009 Stirm et al.
7,588,097 B2 9/2009 Kamegai et al.
7,604,071 B2 10/2009 Ikuta
7,637,328 B2 12/2009 Sato
7,712,547 B2 5/2010 Ikuta et al.
7,766,096 B2 8/2010 Satou et al.
7,784,562 B2 8/2010 Ikuta
7,806,201 B2 10/2010 Aoki
7,832,498 B2 11/2010 Sugiyama et al.
7,921,934 B2 4/2011 Aoki
7,940,025 B2 * 5/2011 Duesselberg ..... B25F 5/02 429/96
8,016,047 B2 9/2011 Ookubo et al.
8,087,472 B2 1/2012 Usselman et al.
8,109,344 B1 * 2/2012 Hays ..... B25F 3/00 173/171
8,127,862 B2 3/2012 Aoki
8,181,715 B2 5/2012 Bito et al.
8,196,674 B2 6/2012 Ikuta et al.
8,235,138 B2 8/2012 Aoki
8,261,851 B2 9/2012 Ikuta et al.
8,347,981 B2 * 1/2013 Aoki ..... B25D 17/24 173/211
8,561,716 B2 10/2013 Aoki
8,668,026 B2 3/2014 Aoki
8,695,724 B2 4/2014 Nakashima
8,783,377 B2 7/2014 Baumann et al.
8,844,647 B2 9/2014 Kamegai et al.
9,085,075 B2 7/2015 Ikuta
9,156,152 B2 10/2015 Machida
9,321,163 B2 4/2016 Onoda et al.
9,358,677 B2 * 6/2016 Kuhnle ..... B25F 5/006
9,782,173 B2 * 10/2017 Mozdzierz ..... A61B 17/07292
2001/0022314 A1 * 9/2001 Raffoni ..... B27F 7/003 227/154
2003/0141765 A1 * 7/2003 Chu ..... H01C 10/12 338/215
2006/0076154 A1 * 4/2006 Aoki ..... B25D 17/245 173/212
2006/0175373 A1 * 8/2006 Erhardt ..... B25C 1/08 227/10
2006/0175374 A1 * 8/2006 Zahner ..... B25C 1/08 227/10
2006/0289185 A1 12/2006 Hahn
2007/0107920 A1 5/2007 Keller
2007/0138230 A1 * 6/2007 Gschwend ..... B25C 1/08 227/10
2008/0179797 A1 * 7/2008 Manschitz ..... B25D 17/24 267/137
2009/0090528 A1 * 4/2009 Manschitz ..... B25D 17/24 173/162.1
2009/0095499 A1 * 4/2009 Satou ..... F16F 15/22 173/210
2009/0151967 A1 * 6/2009 Haas ..... B25D 17/24 173/162.1
2009/0223693 A1 * 9/2009 Aoki ..... B25D 16/00 173/211
2009/0236111 A1 * 9/2009 Hahn ..... B25D 17/043 173/162.2
2010/0307783 A1 * 12/2010 Baumann ..... B25B 21/02 173/162.2
2010/0314212 A1 * 12/2010 Akiyoshi ..... F16C 35/063 192/66.1
2011/0011608 A1 * 1/2011 Saur ..... B25D 17/24 173/162.2
2011/0024149 A1 * 2/2011 Hecht ..... B25D 17/24 173/162.2
2011/0155405 A1 * 6/2011 Aoki ..... B25D 17/245 173/162.2
2012/0118598 A1 5/2012 Iio
2012/0209203 A1 * 8/2012 Gibertoni ..... A61M 1/86 604/164.11
2012/0255753 A1 10/2012 Kuhnle et al.
2012/0261153 A1 10/2012 Aoki
2012/0279741 A1 * 11/2012 Schlesak ..... B25D 17/24 173/162.2
2012/0318551 A1 * 12/2012 Kuhnle ..... B25F 5/006 173/162.2
2015/0266176 A1 9/2015 Takeuchi et al.
2015/0328579 A1 11/2015 Ikuta et al.
2015/0367492 A1 * 12/2015 Lindell ..... B25D 17/24 173/211
2015/0367494 A1 * 12/2015 Wang ..... B25F 5/006 30/392
2016/0052119 A1 2/2016 Yamada et al.
2017/0361447 A1 * 12/2017 Ontl ..... F16F 7/104

FOREIGN PATENT DOCUMENTS

EP 1157788 A2 * 11/2001 ..... B25D 16/00
GB 1154593 A 6/1969

(56) References Cited

FOREIGN PATENT DOCUMENTS

| | | | |
|---|---|---|---|
| JP | 2003041805 | A | 2/2003 |
| WO | 2007077946 | A2 | 7/2007 |
| WO | 2007105742 | A1 | 9/2007 |

OTHER PUBLICATIONS

International Preliminary Report on Patentability for Application No. PCT/US2019/025718 dated Oct. 15, 2020 (11 pages).
Partial Supplementary European Search Report for Application No. 19781097.1 dated Nov. 30, 2021 (17 pages).
Extended European Search Report for Application No. 19781097.1 dated Mar. 9, 2022 (13 pages).

* cited by examiner

ROTARY HAMMER

CROSS-REFERENCE TO RELATED APPLICATIONS

This application claims priority to U.S. Provisional Patent Application No. 62/652,580 filed Apr. 4, 2018, and the entire contents of which is incorporated herein by reference.

FIELD OF THE INVENTION

The present invention relates to rotary power tools, and more particularly to rotary hammers.

BACKGROUND OF THE INVENTION

Rotary hammers impart rotation and axial impacts to a drill bit while performing a drilling or breaking operation on a work surface. In response to the axial impacts, rotary hammers, and users handling them, experience vibration.

SUMMARY OF THE INVENTION

The present invention provides, in one aspect, a rotary hammer adapted to impart axial impacts to a tool bit. The rotary hammer comprises a housing, a motor supported by the housing, a gearcase, and a spindle housed in the gearcase and coupled to the motor for receiving torque from the motor, causing the spindle to rotate. The rotary hammer also comprises a reciprocating impact mechanism operable to create a variable pressure air spring within the spindle. The impact mechanism includes a striker received within the spindle for reciprocation along a reciprocation axis in response to the pressure of the air spring. The striker imparts axial impacts to the tool bit. The rotary hammer also comprises a vibration damping mechanism including a base on the gearcase, a counterweight circumscribing the base, and a first spring arranged between the base and the counterweight and defining a first biasing axis that is parallel to the reciprocation axis. The first spring biases the counterweight away from the base in a first direction. The vibration damping mechanism also includes a second spring arranged between the base and the counterweight and arranged along the first biasing axis. The second spring biases the counterweight away from the base in a second direction that is opposite the first direction. The counterweight is movable for reciprocation along the first biasing axis out of phase with the reciprocation mechanism. The first and second springs bias the counterweight toward a neutral position when the motor is deactivated.

The present invention provides, in another aspect, a rotary hammer adapted to impart axial impacts to a tool bit. The rotary hammer comprises a housing, a motor supported by the housing, a gearcase, and a spindle housed in the gearcase and coupled to the motor for receiving torque from the motor, causing the spindle to rotate. The rotary hammer also comprises a reciprocating impact mechanism operable to create a variable pressure air spring within the spindle. The impact mechanism includes a striker received within the spindle for reciprocation along a reciprocation axis in response to the pressure of the air spring. The striker imparts axial impacts to the tool bit. The rotary hammer also comprises a vibration damping mechanism including a base on the gearcase, a first counterweight, a second counterweight coupled to the first counterweight and arranged on a side of the base that is opposite the first counterweight, and a first spring arranged between the base and the first counterweight and defining a first biasing axis that is parallel to the reciprocation axis. The first spring biases the first counterweight away from the base. The vibration damping mechanism further includes s second spring arranged between the base and the second counterweight and arranged along the first biasing axis. The second spring biases the second counterweight away from the base. The first and second counterweights are movable together for reciprocation along the first biasing axis out of phase with the reciprocation mechanism. The first and second springs respectively bias the first and second counterweights toward a neutral position when the motor is deactivated.

The present invention provides, in yet another aspect, a rotary hammer adapted to impart axial impacts to a tool bit. The rotary hammer comprises a housing, a motor supported by the housing, a spindle coupled to the motor for receiving torque from the motor, causing the spindle to rotate, and a reciprocating impact mechanism operable to create a variable pressure air spring within the spindle. The impact mechanism includes a striker received within the spindle for reciprocation along a reciprocation axis in response to the pressure of the air spring, the striker imparting axial impacts to the tool bit. The rotary hammer further comprises a vibration damping mechanism including a counterweight with a curvilinear portion, a first spring arranged on a first side of the counterweight and defining a first biasing axis, and a second spring arranged along the first biasing axis on a second side of the counterweight. The rotary hammer further comprises a gearcase in which the spindle is housed. The gearcase has a mating curvilinear portion. The counterweight is movable for reciprocation along the mating curvilinear portion of the gearcase and along the first biasing axis out of phase with the reciprocation mechanism. The first spring biases the counterweight towards the second spring and the second spring biases the counterweight towards the first spring, such that the counterweight is biased toward a neutral position when the motor is deactivated.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
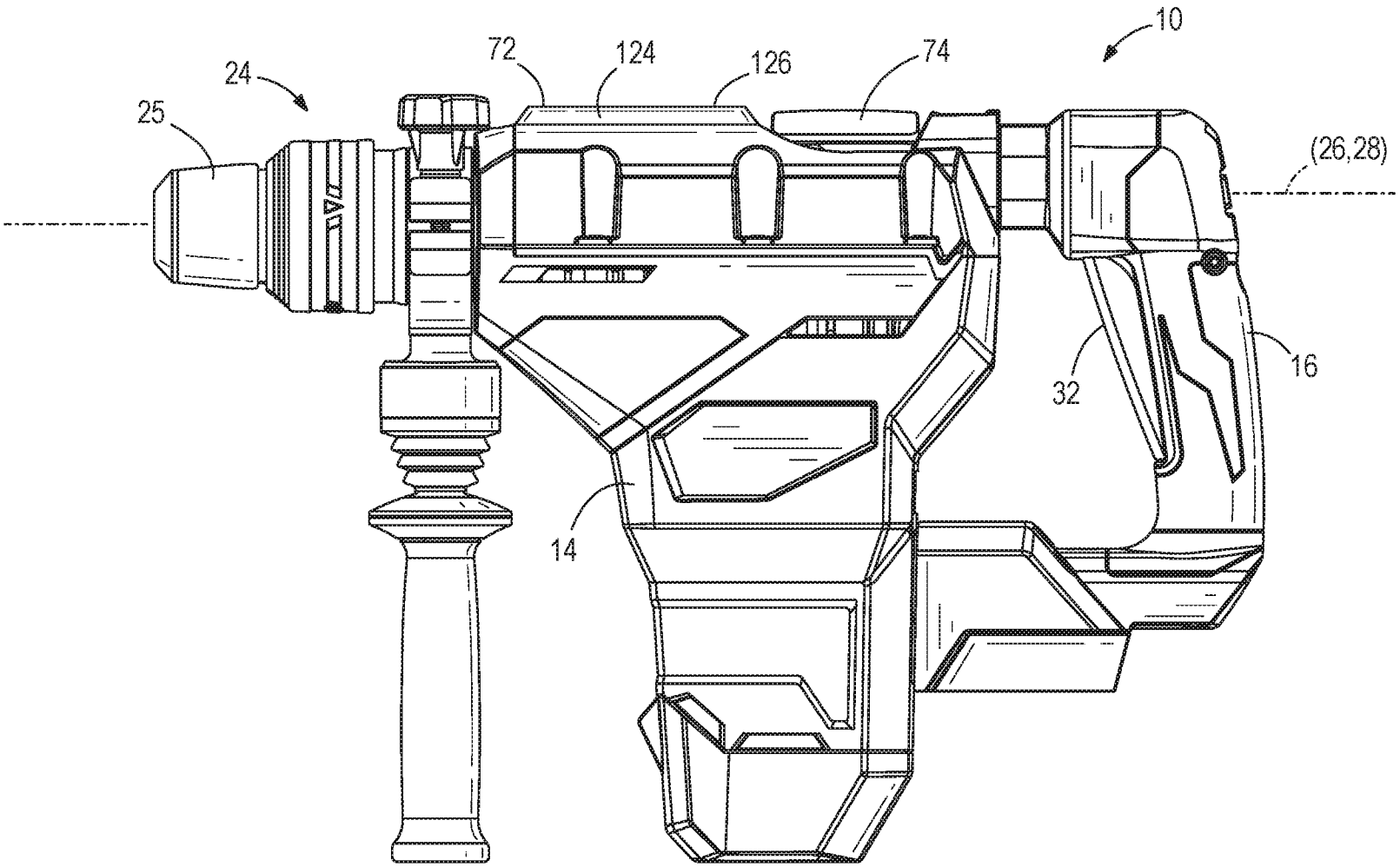
FIG. 1 is a plan view of a rotary hammer.
Figure 2:
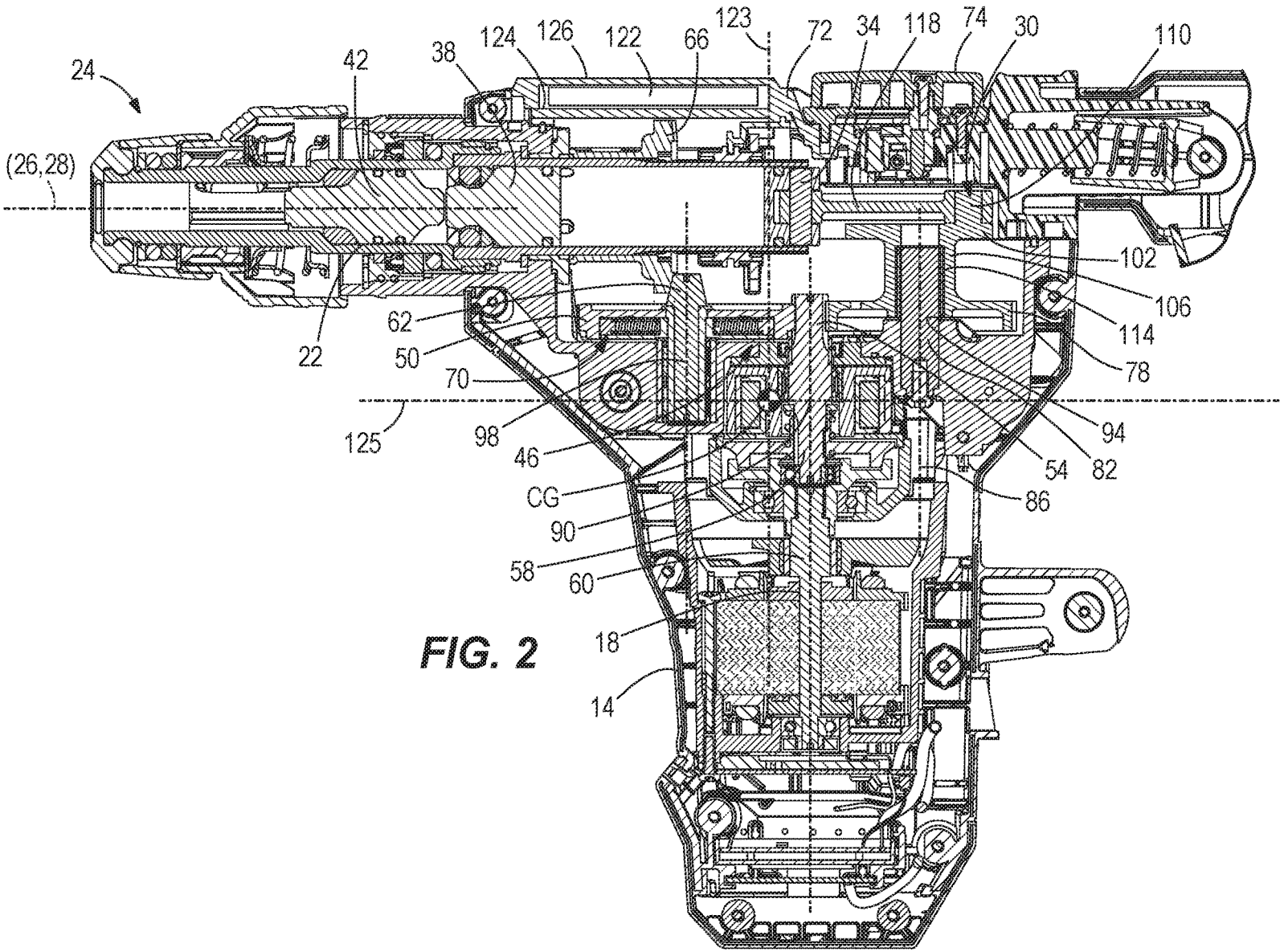
FIG. 2 is a cross-sectional view of the rotary hammer of FIG. 1 with portions removed.

FIGS. 1 and 2 illustrate a rotary power tool, such as rotary hammer 10, according to an embodiment of the invention. The rotary hammer 10 includes a housing 14 having a handle 16, a motor 18 disposed within the housing 14, and a rotatable spindle 22 coupled to the motor 18 for receiving torque from the motor 18. In the illustrated embodiment, the rotary hammer 10 includes a quick-release mechanism 24 coupled for co-rotation with the spindle 22 to facilitate quick removal and replacement of different tool bits. A tool bit 25 may include a necked section or a groove in which a detent member of the quick-release mechanism 24 is received to constrain axial movement of the tool bit 25 to the length of the necked section or groove. The rotary hammer 10 defines a tool bit reciprocation axis 26, which in the illustrated embodiment is coaxial with a rotational axis 28 of the spindle 22. The motor 18 is selectively activated by depressing an actuating member, such as a trigger 32, which in turn actuates an electrical switch. In the illustrated embodiment, the motor 18 is powered by an AC power source. However, in other embodiments, the motor 18 is capable of being powered by a DC power source, such as a battery pack.

The rotary hammer 10 further includes a reciprocating impact mechanism 30 (FIG. 2) having a reciprocating piston 34 disposed within the spindle 22, a striker 38 that is selectively reciprocable within the spindle 22 in response to a variable pressure air spring developed within the spindle 22 by reciprocation of the piston 34, and an anvil 42 that is impacted by the striker 38 when the striker 38 reciprocates toward the tool bit 25. The impact is then transferred from the anvil 42 to the tool bit 25. Torque from the motor 18 is transferred to the spindle 22 by a transmission 46. In the illustrated embodiment of the rotary hammer 10, the transmission 46 includes an input gear 50 engaged with a pinion 54 on an intermediate shaft 58 that is driven by a motor output shaft 60, an intermediate pinion 62 coupled for co-rotation with the input gear 50, and an output gear 66 coupled for co-rotation with the spindle 22 and engaged with the intermediate pinion 62. The output gear 66 is secured to the spindle 22 using a spline-fit or a key and keyway arrangement, for example, that facilitates axial movement of the spindle 22 relative to the output gear 66 yet prevents relative rotation between the spindle 22 and the output gear 66. A clutch mechanism 70 is incorporated with the input gear 50 to limit the amount of torque that may be transferred from the motor 18 to the spindle 22. As shown in FIGS. 1 and 2, the impact mechanism 30 is arranged in a gearcase 72, at least a portion of which is external to the housing 14.

With reference to FIGS. 1 and 2, the rotary hammer 10 includes a mode selection member 74 rotatable by an operator to switch between three modes. In a "hammer-drill" mode, the motor 18 is drivably coupled to the piston 34 for reciprocating the piston 34 while the spindle 22 rotates. In a "drill-only" mode, the piston 34 is decoupled from the motor 18 but the spindle 22 is rotated by the motor 18. In a "hammer-only" mode, the motor 18 is drivably coupled to the piston 34 for reciprocating the piston 34 but the spindle 22 does not rotate.

The impact mechanism 30 is driven by another input gear 78 (FIG. 2) that is rotatably supported within the housing 14 on a stationary intermediate shaft 82, which defines a central axis 86 that is offset from a rotational axis 90 of the intermediate shaft 58 and pinion 54. A bearing 94 (e.g., a roller bearing, a bushing, etc.) rotatably supports the input gear 78 on the stationary intermediate shaft 82. As shown in FIG. 1, the respective axes 86, 90 of the intermediate shaft 82 and intermediate shaft 58 are parallel. Likewise, respective axes 90, 98 of the intermediate shaft 58 and the intermediate pinion 62 are also parallel. The impact mechanism 30 also includes a crank shaft 102 having a hub 106 integrally formed with the input gear 78 and an eccentric pin 110 that is integrally formed with the crank shaft 102. The hub 106 is rotatably supported on the stationary shaft 82 by a bearing 114 (e.g., a roller bearing, a bushing, etc.). In some embodiments, the input gear 78, crank shaft 102, hub 106, and eccentric pin 110 are all formed as one piece. The impact mechanism 30 further includes a connecting rod 118 interconnecting the piston 34 and the eccentric pin 110.

Figure 3:
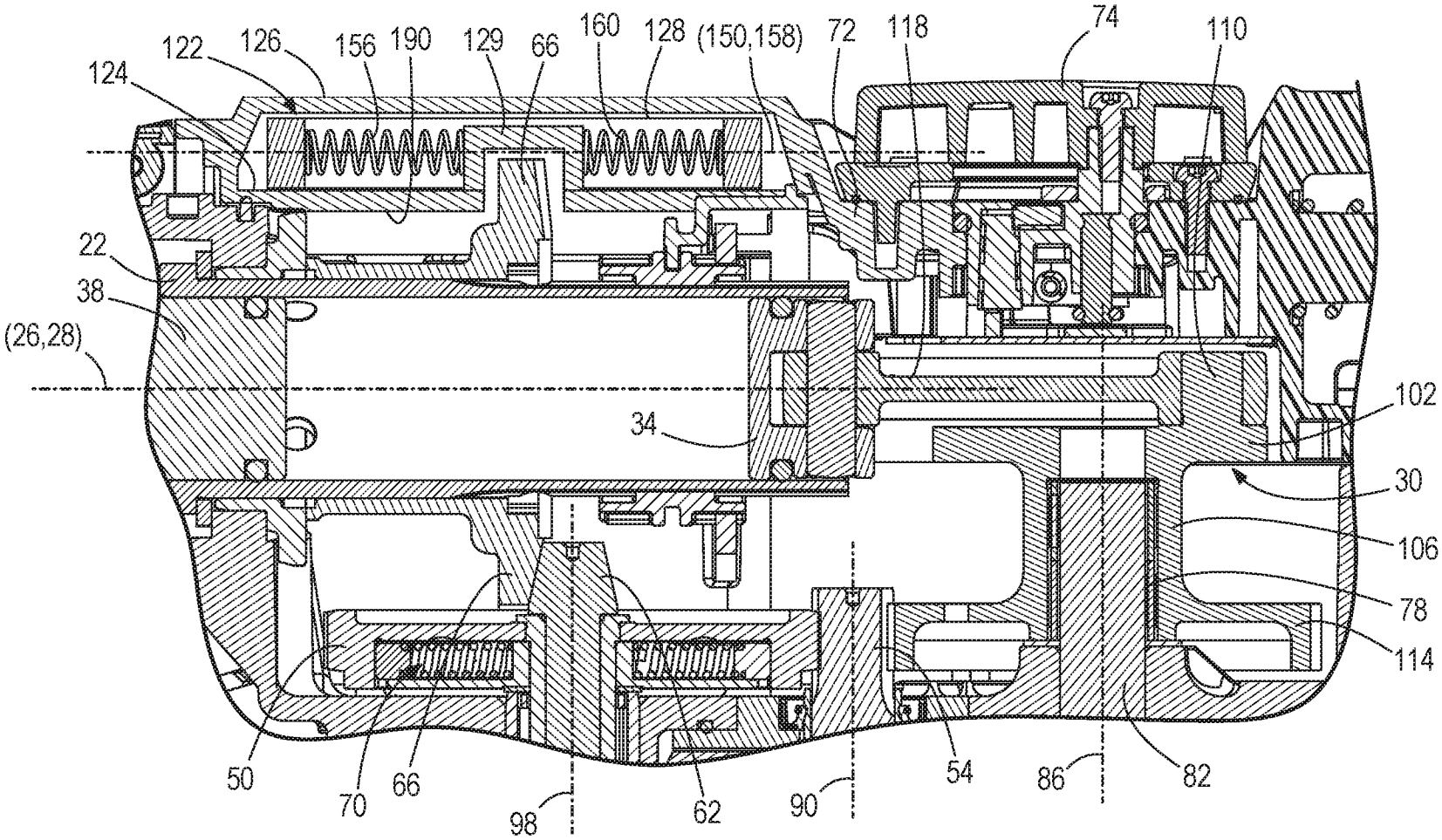
FIG. 3 is an enlarged cross-sectional view of the rotary hammer of FIG. 1 with portions removed.
Figure 4:
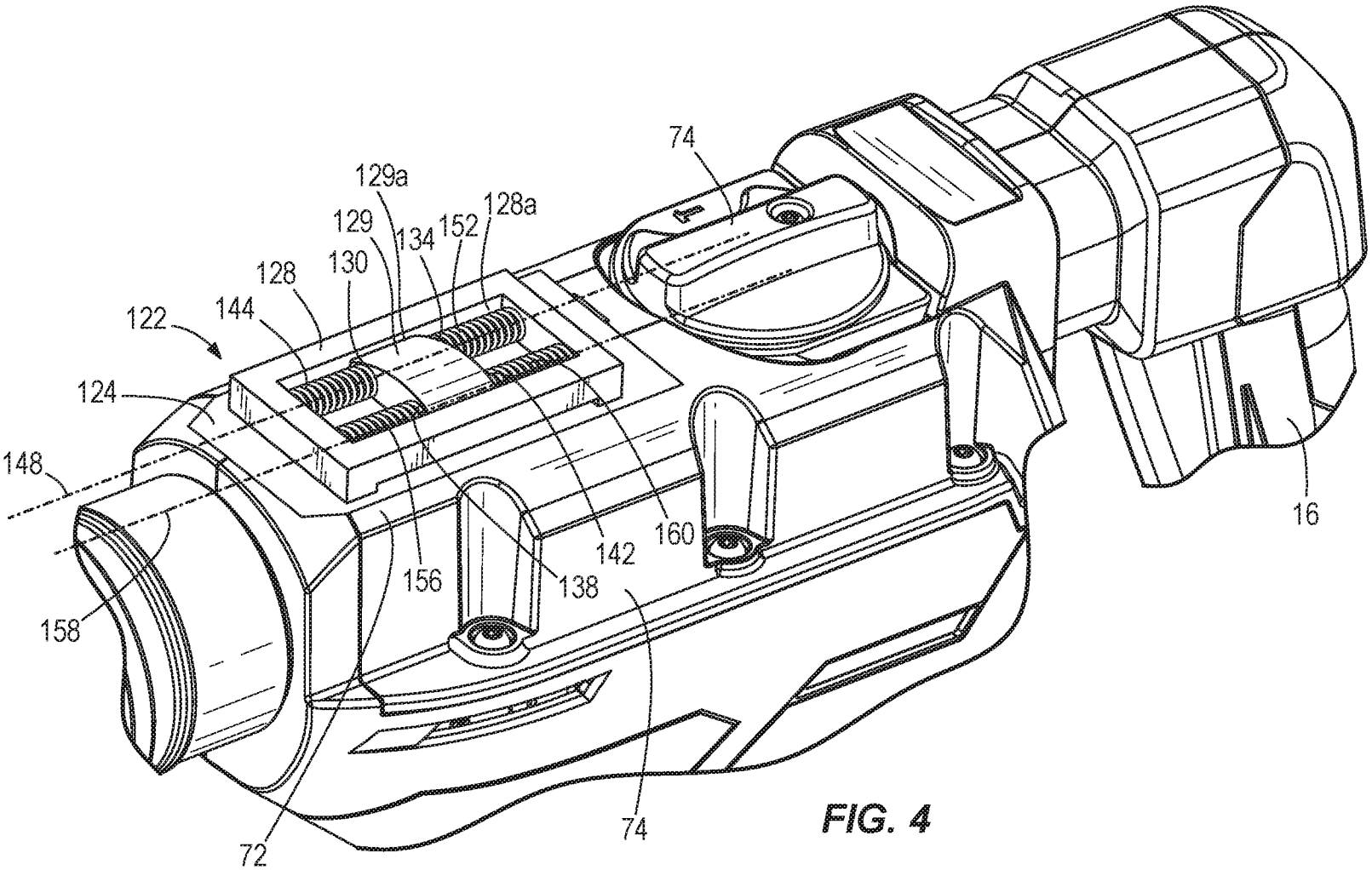
FIG. 4 is a perspective view of the rotary hammer of FIG. 1, with a gearcase cover removed.

As shown in FIGS. 2-4, the rotary hammer 10 includes a vibration damping mechanism 122 for attenuating vibration created by the rotary hammer 10. In some embodiments, the vibration damping mechanism 122 attenuates vibration created by the impact mechanism 30. In some embodiments, the vibration damping mechanism 122 attenuates vibration created by the reciprocating piston 34 during a hammer-drilling operation or a hammering operation. As shown in FIG. 2, the vibration damping mechanism 122 is offset from a vertical plane 123 containing the center of gravity (CG) of the rotary hammer 10 in a forward direction (i.e., toward the quick-release mechanism 24). In some embodiments, the vibration damping mechanism 122 is offset from the vertical plane 123 in a rearward direction (i.e., away from the quick-release mechanism).

In some embodiments, the vibration damping mechanism 122 is intersected by the vertical plane 123, but is offset from a horizontal plane 125 that is parallel to the reciprocation axis 26 and contains the center of gravity (CG). Specifically, the vibration damping mechanism 122 may be above the horizontal plane 125, toward the top of the rotary hammer 10, or may be below the horizontal plane 125, toward the bottom of the rotary hammer 10. In some embodiments, the vibration damping mechanism 122 is offset from both the vertical plane 123 and the horizontal plane 125. For example, in the embodiment illustrated in FIG. 2, the vibration damping mechanism 122 is offset from the vertical plane 123 in a forward direction and offset from the horizontal plane 125 in an upward direction.

In the embodiment illustrated in FIGS. 3 and 4, the vibration damping mechanism 122 is arranged on an exterior surface 124 of the gearcase 72 and is enclosed by a gearcase cover 126, which has been removed for clarity in FIG. 4. The vibration damping mechanism 122 includes a counterweight 128. The vibration damping mechanism 122 also includes a base 129, which is integrally formed with the gearcase 72, having a front end with two spaced spring seats 130, 138 and a rear end with two spaced spring seats 134, 142 (FIG. 4).

With continued reference to the embodiment illustrated in FIGS. 3 and 4, a first spring 144 is arranged between the first spring seat 130 and the counterweight 128 and defines a first biasing axis 148. A second spring 152 is arranged along the first biasing axis 148 between the second spring seat 134 and the counterweight 128. A third spring 156 is arranged between the third spring seat 138 and the counterweight 128 and defines a second biasing axis 158. A fourth spring 160 is arranged along the second biasing axis 158 between the fourth spring seat 142 and the counterweight 128. The first and second biasing axes 148, 158 are parallel to the reciprocation axis 26. The first and third springs 144, 148 bias the counterweight 128 in a first direction, whereas the second and fourth springs 146, 150 bias the counterweight 128 in a second direction that is opposite the first direction. The springs 144, 146, 148, 150 have identical stiffness; therefore, the counterweight 128 is biased toward a neutral position (shown in FIGS. 4 and 5) relative to the base 129 when the motor 18 and the impact mechanism 30 are deactivated. As shown in FIG. 4, the base 129 is circumscribed by the counterweight 128 and sides 128*a* of the counterweight 128 are in contact with and slide against sides 129*a* of the base 129, so as to limit the movement of the counterweight 128 to a direction along the first and second biasing axes 148, 158 and prevent lateral movement of the counterweight 128 (i.e. in a direction perpendicular to the first and second biasing axes 148, 158).

In the illustrated embodiment of the vibration damping mechanism 122 shown in FIG. 4, the counterweight 128 has a rectangular shape. The width of the base 129 is nominally less than the internal width of the counterweight 128, such that the base 129 also functions as a guide along which the sides of the counterweight 128 may slide to limit movement of the counterweight 128 to reciprocation along the axes 148, 158.

Figure 5:
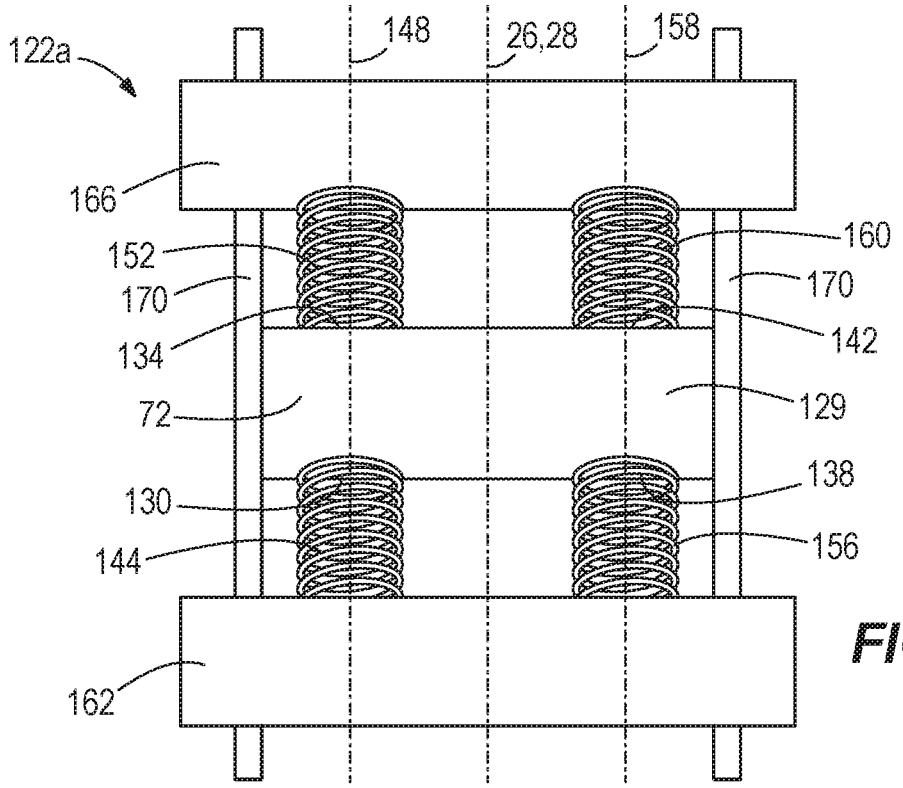
FIG. 5 is a plan view of a vibration damping mechanism of the rotary hammer of FIG. 1.
Figure 6:
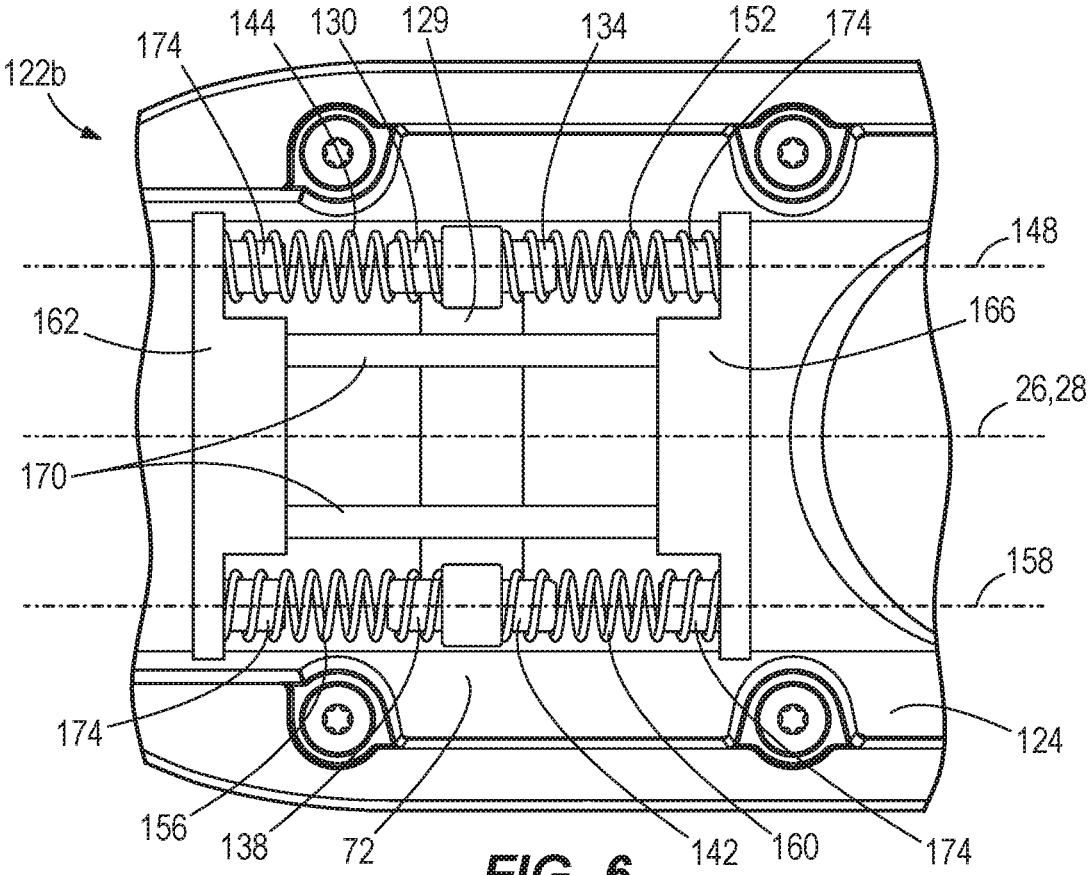
FIG. 6 is a plan view of another embodiment of a vibration damping mechanism for use with the rotary hammer of FIG. 1.

In another embodiment shown in FIG. 5, a vibration damping mechanism 122*a* includes two separate counterweights 162, 166 that are connected by bars 170. In other words, the two separate counterweights 162, 166 are coupled by separate coupling members (i.e., bars 170). In the embodiment illustrated in FIG. 5, the bars 170 are outside or laterally outboard the springs 144, 152, 156, 160. In another embodiment of a vibration damping mechanism 122*b* illustrated in FIG. 6, the bars 170 are between or laterally inboard the springs 144, 152, 156, 160. Also, in the embodiment illustrated in FIG. 6, the first through fourth spring seats 130, 134, 138, 142 are configured as posts on the base 129 upon which the springs 144, 152, 156, 160 are received. Also, in the embodiment illustrated in FIG. 6, the counterweights 162, 166 include posts 174 to receive the springs 144, 152, 156, 160. Also, in the embodiment illustrated in FIG. 6, the bars 170 are between the springs 144, 152, 156, 160.

Figure 7:
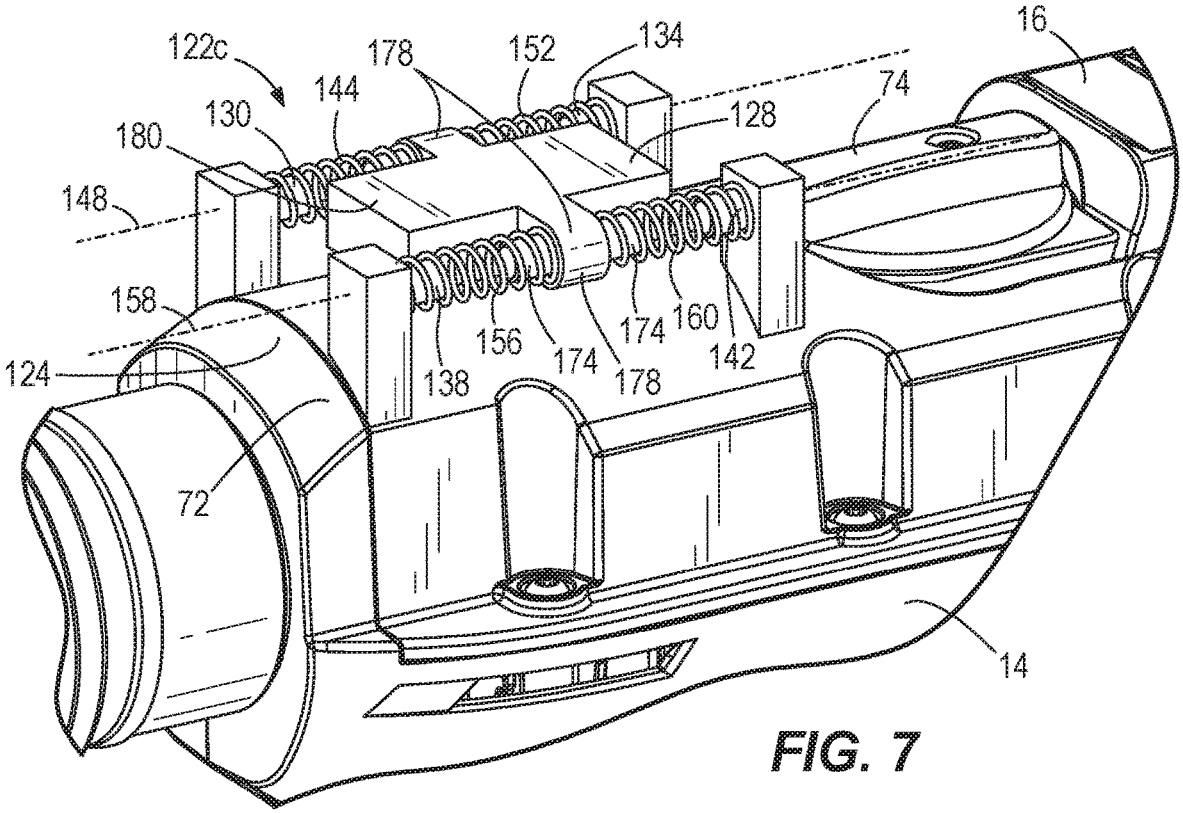
FIG. 7 is a perspective view of another embodiment of a vibration damping mechanism for use with the rotary hammer of FIG. 1.
Figure 8:
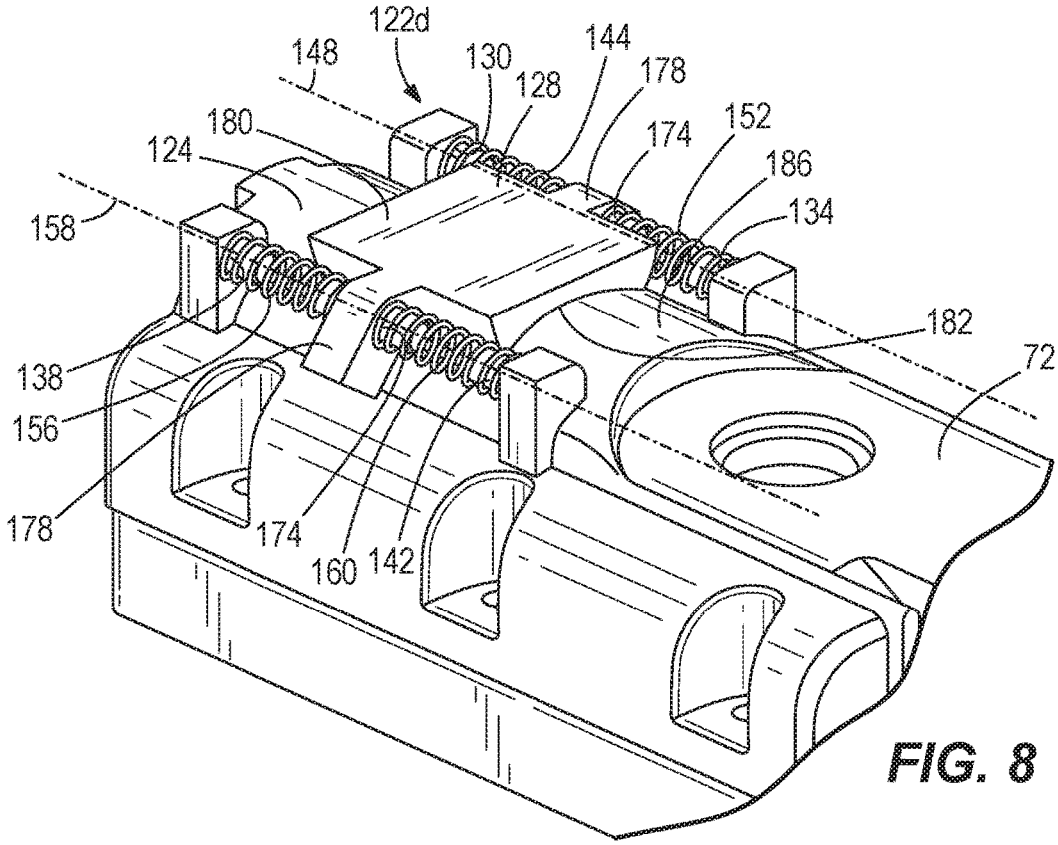
FIG. 8 is a perspective view of another embodiment of a vibration damping mechanism for use with the rotary hammer of FIG. 1.
Figure 9:
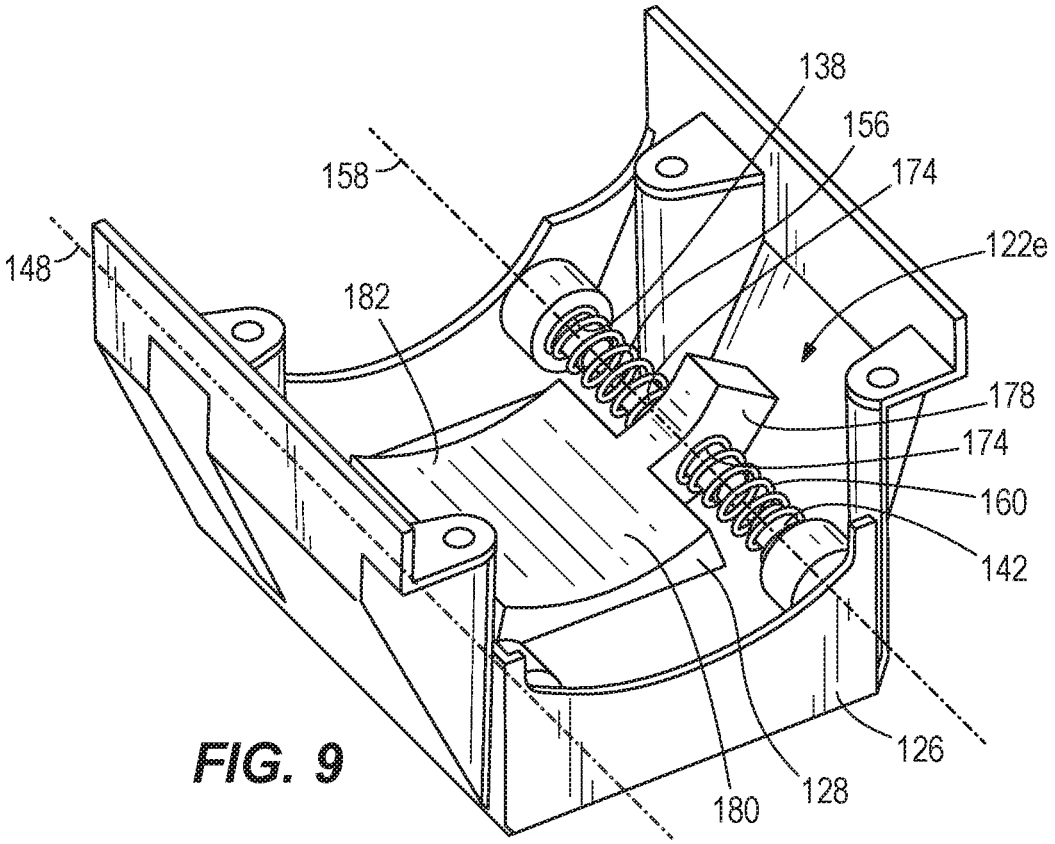
FIG. 9 is a perspective view of another embodiment of a vibration damping mechanism for use with the rotary hammer of FIG. 1.
Figure 10:
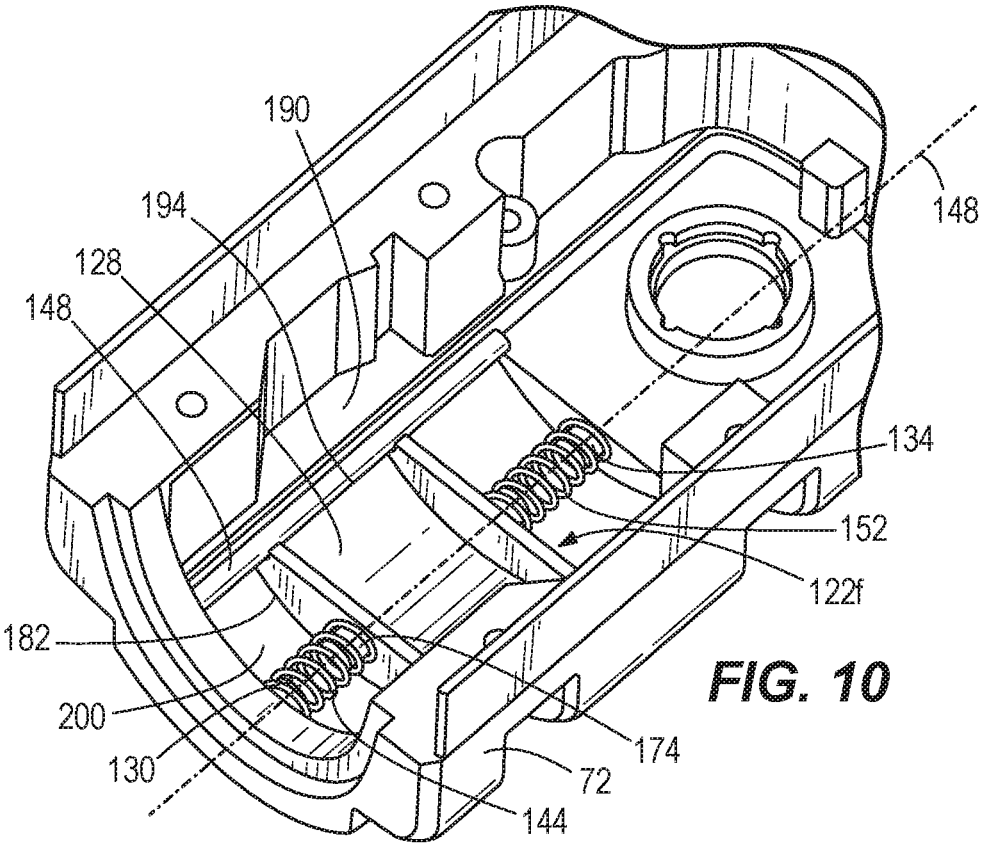
FIG. 10 is a perspective view of another embodiment of a vibration damping mechanism for use with the rotary hammer of FIG. 1.
Figure 11:
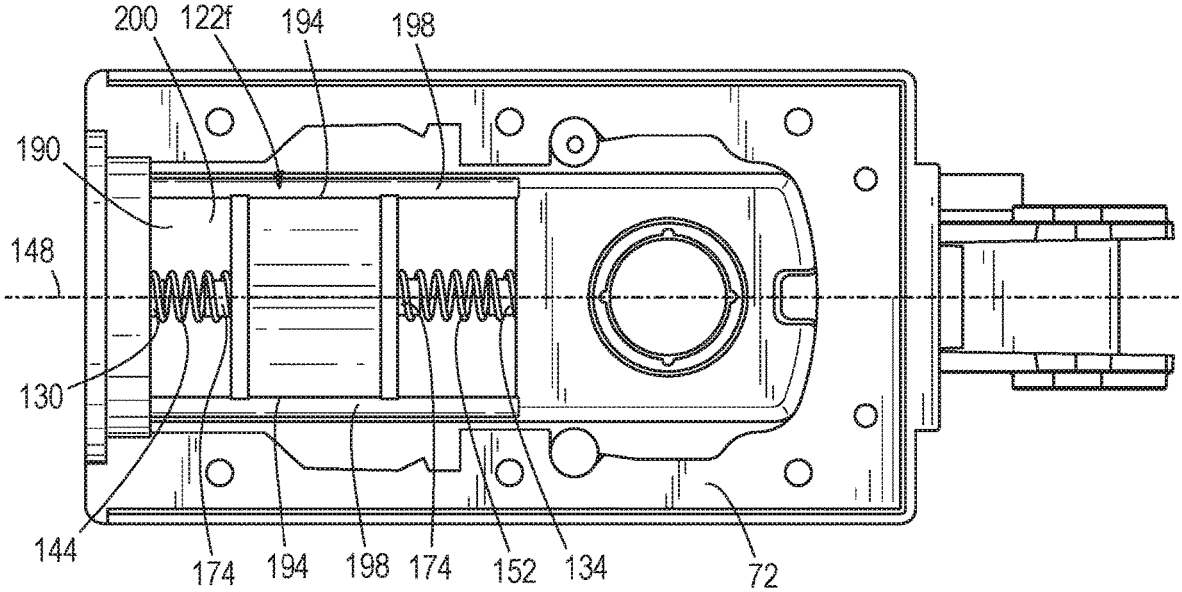
FIG. 11 is a plan view of the vibration damping mechanism of FIG. 10.

In another embodiment of a vibration damping mechanism 122*c* shown in FIG. 7, the counterweight 128 is arranged between the spring seats 130, 134, 138, 142 and the springs 144, 152, 156, 160. The counterweight 128 includes two wings 178 extending from a body 180 of the counterweight 128 perpendicular to the biasing axes 148, 158. The wings 178 include the posts 174 that receive the springs 144, 152, 156, 160. In another embodiment of a vibration damping mechanism 122*d* shown in FIG. 8, the counterweight 128 has a concave portion 182, allowing the counterweight 128 to slide along a mating convex portion 186 of the gearcase 72 when the counterweight 128 reciprocates. In FIG. 8, the gearcase cover 126 has been removed for clarity, but once assembled, the vibration damping mechanism 122*d* would be arranged on the gearcase 72 and within the gearcase cover 126. In another embodiment of a vibration damping mechanism 122*e* shown in FIG. 9, all of the components of the vibration damping mechanism 122*e* are arranged on the gearcase cover 126 instead of on the gearcase 72.

In the embodiments of FIGS. 10-14 below, the vibration damping mechanism is arranged in an interior chamber 190 of the gearcase 72. In the embodiment of a vibration damping mechanism 122*f* shown in FIGS. 10 and 11, the vibration damping mechanism 122*f* is arranged in the interior chamber 190 of the gearcase 72. The vibration damping mechanism 122*f* only includes the first spring seat 130 and second spring seat 134, configured as posts, and only the first spring 144 and second spring 152 arranged along the first biasing axis 148. The counterweight 128 includes mating edges 194 that slide along rails 198 supported by the gearcase 72 when the counterweight 128 reciprocates. The rails 198 are arranged parallel with the reciprocation axis 26 and the first biasing axis 148. In the embodiment of the vibration damping mechanism 122*f* of FIGS. 10 and 11, the counterweight 128 includes a convex portion 182 that slides along a mating concave portion 200 of the gearcase 72 defining the interior chamber 190.

Figure 12:
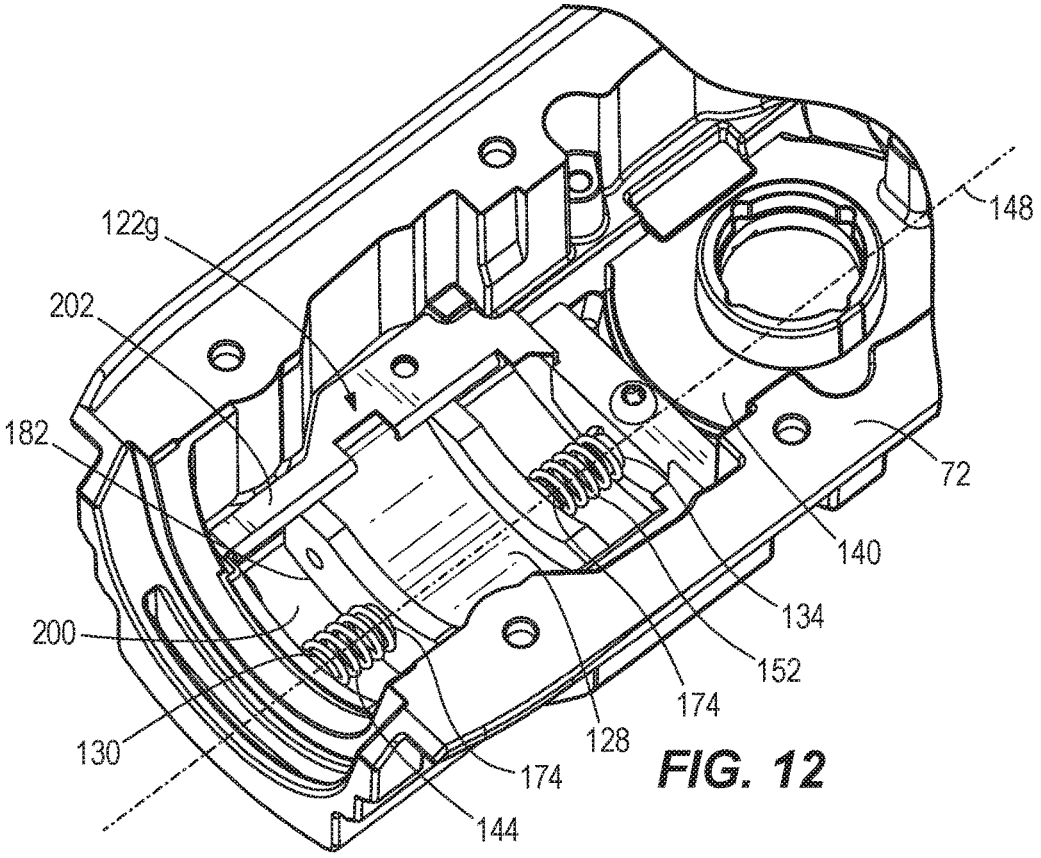
FIG. 12 is a perspective view of another embodiment of a vibration damping mechanism for use with the rotary hammer of FIG. 1.
Figure 13:
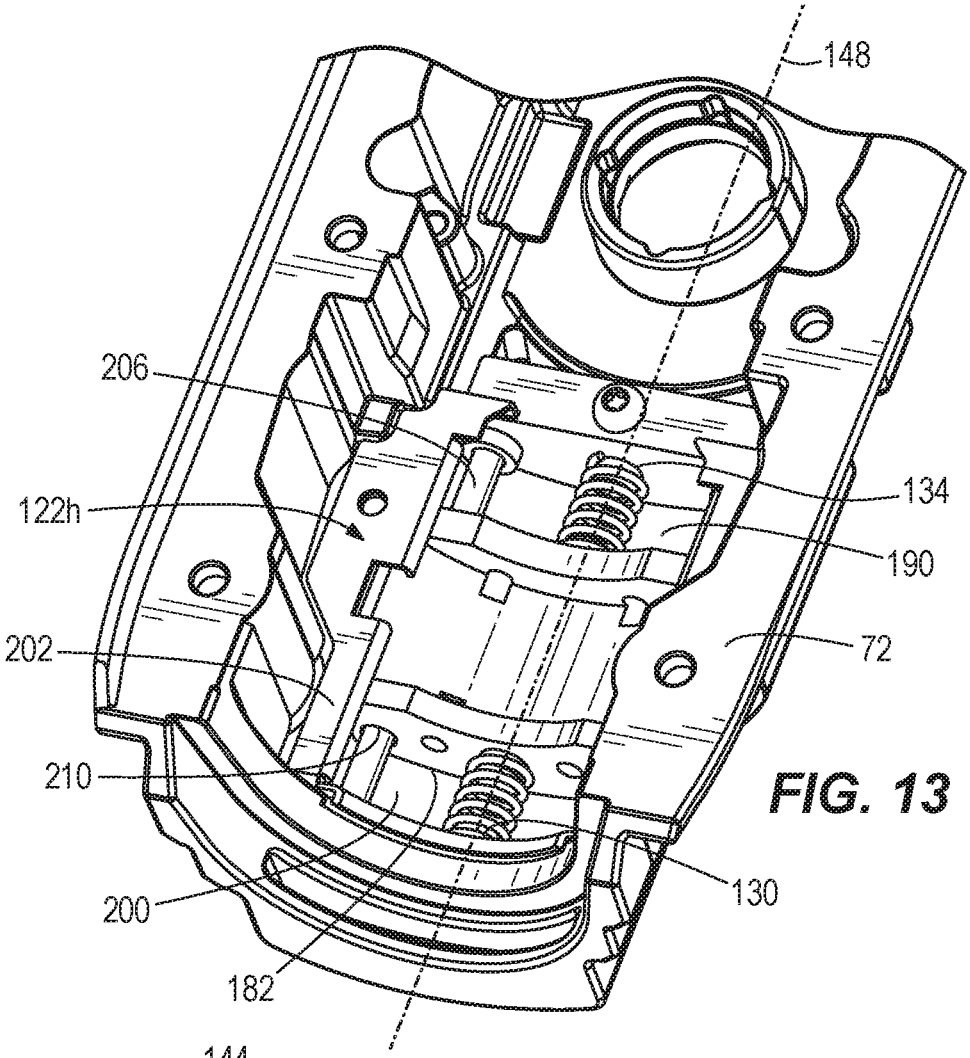
FIG. 13 is a perspective view of another embodiment of a vibration damping mechanism for use with the rotary hammer of FIG. 1.
Figure 14:
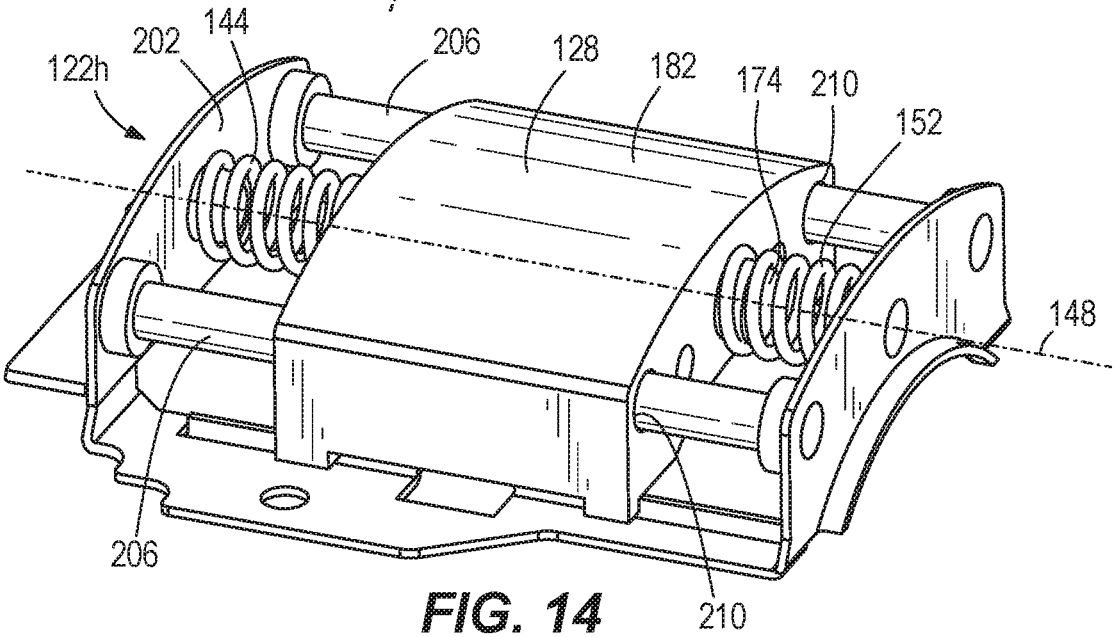
FIG. 14 is a perspective view of the vibration damping mechanism of FIG. 13.

In another embodiment of a vibration damping mechanism 122*g* shown in FIG. 12, a frame 202 is coupled to the gearcase 72 within the interior chamber 190. The frame 202 includes the first spring seat 130 and second spring seat 134, which are configured as posts. In another embodiment of a vibration damping mechanism 122*h* shown in FIGS. 13 and 14, the frame 202 includes rails 206 that are parallel with the reciprocation axis 26 and the first biasing axis 148. The rails 206 extend through bores 210 defined in the counterweight 128, such that the counterweight 128 may reciprocate along the rails 206.

In operation, an operator selects hammer-drill mode with the mode selection member 74. The operator then depresses the trigger 32 to activate the motor 18. The motor output shaft 60 rotates the intermediate shaft 58, thus causing the pinion 54 to rotate the input gear 50 to rotate. Rotation of the input gear 50 causes the intermediate pinion 62 to rotate, which drives the output gear 66 on the spindle 22, causing the spindle 22 and the tool bit 25 to rotate.

Rotation of the pinion 54 also causes the input gear 78 to rotate about the intermediate shaft 82, which causes the crankshaft 102 and the eccentric pin 110 to rotate as well. If "hammer-drill" mode has been selected, rotation of the eccentric pin 110 causes the piston 34 to reciprocate within the spindle 22 via the connecting rod 118, which causes the striker 38 to impart axial blows to the anvil 42, which in turn causes reciprocation of the tool bit 25 against a workpiece. Specifically, a variable pressure air pocket (or an air spring) is developed between the piston 34 and the striker 38 when the piston 34 reciprocates within the spindle 22, whereby expansion and contraction of the air pocket induces reciprocation of the striker 38. The impact between the striker 38 and the anvil 42 is then transferred to the tool bit 25, causing it to reciprocate for performing work on a workpiece or work surface.

During operation of the rotary hammer 10 in either the hammer-drill mode or hammer-only mode, in response to the tool bit 25 receiving axial impacts from the anvil, vibration from the axial impacts is generated and translated to the operator through the housing 14 and handle 16. However, the vibration damping mechanism 122 attenuates this vibration. Specifically, the counterweight 128 reciprocates out of phase with reciprocation of the piston 34, and is continually biased toward a neutral position by the springs 144, 152, 156, 160. In some embodiments, the counterweight 128 is guided by either the base 129 or rails 198, 206. The reciprocating movement of the counterweight 128 reduces the vibration transmitted through the housing 14 and handle 16 to the user. In some embodiments, the counterweight 128 reciprocates out of phase with the rotary hammer 10 itself.

Various features of the invention are set forth in the following claims.

What is claimed is:

1. A rotary hammer adapted to impart axial impacts to a tool bit, the rotary hammer comprising:

a housing;

a motor supported by the housing;

a gearcase;

a spindle housed in the gearcase and coupled to the motor for receiving torque from the motor, causing the spindle to rotate;

a reciprocating impact mechanism operable to create a variable pressure air spring within the spindle, the impact mechanism including a striker received within the spindle for reciprocation along a reciprocation axis in response to the pressure of the air spring, the striker imparting axial impacts to the tool bit; and a vibration damping mechanism including a base on the gearcase, a counterweight circumscribing an exterior of the base, a first spring arranged between the base and the counterweight and defining a first biasing axis that is parallel to the reciprocation axis, the first spring biasing the counterweight away from the base in a first direction, and a second spring arranged between the base and the counterweight and arranged along the first biasing axis, the second spring biasing the counterweight away from the base in a second direction that is opposite the first direction, wherein the counterweight is movable for reciprocation along the first biasing axis out of phase with the reciprocation mechanism, and wherein the first and second springs bias the counterweight toward a neutral position when the motor is deactivated.

2. The rotary hammer of claim 1, wherein the vibration damping mechanism further comprises a third spring arranged between the base and the counterweight and defining a second biasing axis that is parallel to the first biasing axis, the third spring biasing the counterweight away from the base in the first direction, and a fourth spring arranged between the base and the counterweight and along the second biasing axis, the third spring biasing the counterweight away from the base in the second direction, and wherein the third and fourth springs bias the counterweight toward a neutral position when the motor is deactivated.

3. The rotary hammer of claim 1, wherein the counterweight has a rectangular shape.

4. The rotary hammer of claim 1, further comprising a gearcase cover coupled to the gearcase and covering the vibration damping mechanism.

5. A rotary hammer adapted to impart axial impacts to a tool bit, the rotary hammer comprising:

a housing;

a motor supported by the housing;

a gearcase;

a spindle housed in the gearcase and coupled to the motor for receiving torque from the motor, causing the spindle to rotate;

a reciprocating impact mechanism operable to create a variable pressure air spring within the spindle, the impact mechanism including a striker received within the spindle for reciprocation along a reciprocation axis in response to the pressure of the air spring, the striker imparting axial impacts to the tool bit; and a vibration damping mechanism including a base on the gearcase, a first counterweight, a second counterweight coupled to the first counterweight by a separate coupling member and arranged on a side of the base that is opposite the first counterweight, a first spring arranged between the base and the first counterweight and defining a first biasing axis that is parallel to the reciprocation axis, the first spring biasing the first counterweight away from the base, and a second spring arranged between the base and the second counterweight and arranged along the first biasing axis, the second spring biasing the second counterweight away from the base, wherein the first and second counterweights are movable together for reciprocation along the first biasing axis out of phase with the reciprocation mechanism, and wherein the first and second springs respectively bias the first and second counterweights toward a neutral position when the motor is deactivated.

6. The rotary hammer of claim 5, wherein the vibration damping mechanism further comprises:

a third spring arranged between the base and the first counterweight and defining a second biasing axis that is parallel to the first biasing axis, the third spring biasing the first counterweight away from the base, and a fourth spring arranged between the base and the second counterweight and arranged along the second biasing axis, and wherein the third and fourth springs respectively bias the first and second counterweights toward a neutral position when the motor is deactivated.

7. The rotary hammer of claim 6, wherein the first and second counterweights are coupled together by a first bar and a second bar.

8. The rotary hammer of claim 7, wherein the first and second bars are laterally outboard the first, second, third, and fourth springs.

9. The rotary hammer of claim 7, wherein the first and second bars are laterally inboard the first, second, third, and fourth springs.

10. The rotary hammer of claim 9, wherein the first counterweight includes a first post to receive the first spring and the second counterweight includes a second post to receive the second spring, and wherein the first counterweight includes a third post to receive the third spring and the second counterweight includes a fourth post to receive the fourth spring.

11. A rotary hammer adapted to impart axial impacts to a tool bit, the rotary hammer comprising:

a housing;

a motor supported by the housing;

a spindle coupled to the motor for receiving torque from the motor, causing the spindle to rotate;

a reciprocating impact mechanism operable to create a variable pressure air spring within the spindle, the impact mechanism including a striker received within the spindle for reciprocation along a reciprocation axis in response to the pressure of the air spring, the striker imparting axial impacts to the tool bit;

a vibration damping mechanism including a counterweight with a curvilinear portion, a first spring arranged on a first side of the counterweight and defining a first biasing axis, and a second spring arranged along the first biasing axis on a second side of the counterweight; and a gearcase in which the spindle is housed, the gearcase having a mating curvilinear portion along which the curvilinear portion of the counterweight reciprocates, wherein the counterweight is movable for reciprocation along the mating curvilinear portion of the gearcase and along the first biasing axis out of phase with the reciprocation mechanism, wherein the first spring biases the counterweight towards the second spring and the second spring biases the counterweight towards the first spring, such that the counterweight is biased toward a neutral position when the motor is deactivated;

wherein the vibration damping mechanism is located in an interior of the gearcase.

12. The rotary hammer of claim 11, wherein the curvilinear portion of the counterweight is a concave surface and the mating curvilinear portion of the gearcase is a convex surface.

13. The rotary hammer of claim 11, wherein the vibration damping mechanism is arranged outside the gearcase.

14. The rotary hammer of claim 13, wherein the vibration damping mechanism further comprises a third spring arranged on the first side off the counterweight along a second biasing axis that is parallel to the first biasing axis.

15. The rotary hammer of claim 14, wherein the vibration damping mechanism further comprises a fourth spring arranged on the second side of the counterweight along the second biasing axis, the third spring biasing the counterweight toward the fourth spring and the fourth spring biasing the counterweight toward the third spring, and wherein the third and fourth springs bias the counterweight toward a neutral position when the motor is deactivated.

16. The rotary hammer of claim 15, wherein the counterweight includes a first wing and a second wing, the first and second wings extending in opposite directions from each other and in a direction perpendicular to the first and second biasing axes, and wherein the first spring is arranged between a first spring seat on the gearcase and the first wing, the second spring is arranged between a second spring seat on the gearcase and the first wing, the third spring is arranged between a third spring seat on the gearcase and the second wing, and the fourth spring is arranged between a fourth spring seat on the gearcase and the second wing.

17. The rotary hammer of claim 14, further comprising a gearcase cover on the gearcase, wherein the vibration damping mechanism is arranged on the gearcase cover.

18. The rotary hammer of claim 11, wherein the vibration damping mechanism includes a rail and the counterweight includes a mating edge that slides along the rail in response to the striker reciprocating along the reciprocation axis.

19. The rotary hammer of claim 11, wherein the counterweight defines a bore extending through the counterweight, wherein the vibration damping mechanism includes a rod extending through the bore, and wherein in response to the striker reciprocating along the reciprocation axis, the counterweight reciprocates along the rod.

* * * * *